United States Patent [19]

Girault et al.

[11] Patent Number: 5,052,709

[45] Date of Patent: Oct. 1, 1991

[54] MOUNTING DEVICE FOR CROSS-COUNTRY SKI BOOT

[75] Inventors: Eric Girault, Synod; Paul Arnulf, Alby Sur Cheran, both of France

[73] Assignee: Salomon S. A., Chavanod, France

[21] Appl. No.: 507,762

[22] Filed: Apr. 12, 1990

[30] Foreign Application Priority Data

Apr. 12, 1989 [FR] France ..... 89 05169

[51] Int. Cl.[5] ..... A63C 9/086

[52] U.S. Cl. ..... 280/615

[58] Field of Search ..... 280/614, 615, 623, 631, 280/632

[56] References Cited

FOREIGN PATENT DOCUMENTS 0072766 2/1983 European Pat. Off. ..... 280/615

3528923 3/1986 Fed. Rep. of Germany ..... 280/615

*Primary Examiner*—Andres Kashnikow

*Assistant Examiner*—Richard Camby

*Attorney, Agent, or Firm*—Pollock, Vande Sande & Priddy

[57] ABSTRACT

Mounting device for a cross-country ski boot having, at its front end, a transverse hinge pin (1) which, while being allowed to rotate, is locked in position between a stationary jaw (10) of the device (30) and a sliding movable jaw (20) biased longitudinally by spring force toward the stationary jaw. The movable jaw (21) has, in transverse section, the shape of a hook designed to clasp the pin of the boot at least longitudinally and vertically, and this hook comprises a horizontal arm (21) having, in longitudinal section, a ramp-shaped profile (21*a*) which increases in size as it extends toward the stationary jaw (10). The horizontal arm (21) of the hook (20) can also have, at each of its lateral ends extending transversely, a ramp-shaped profile (21*b*) which increases in size as it extends from the interior to the exterior of the arm (21).

4 Claims, 1 Drawing Sheet

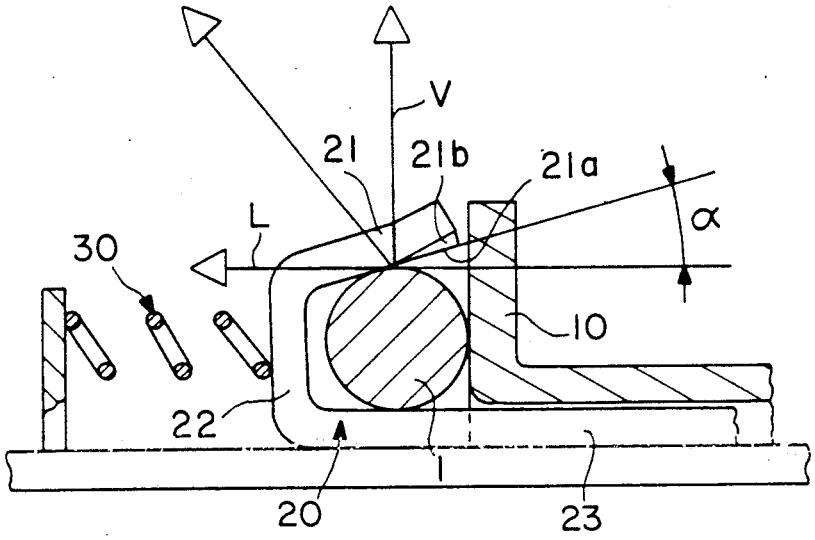
FIG. 1
FIG. 2
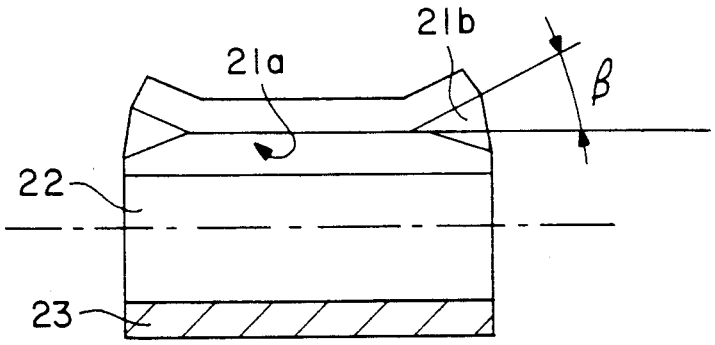
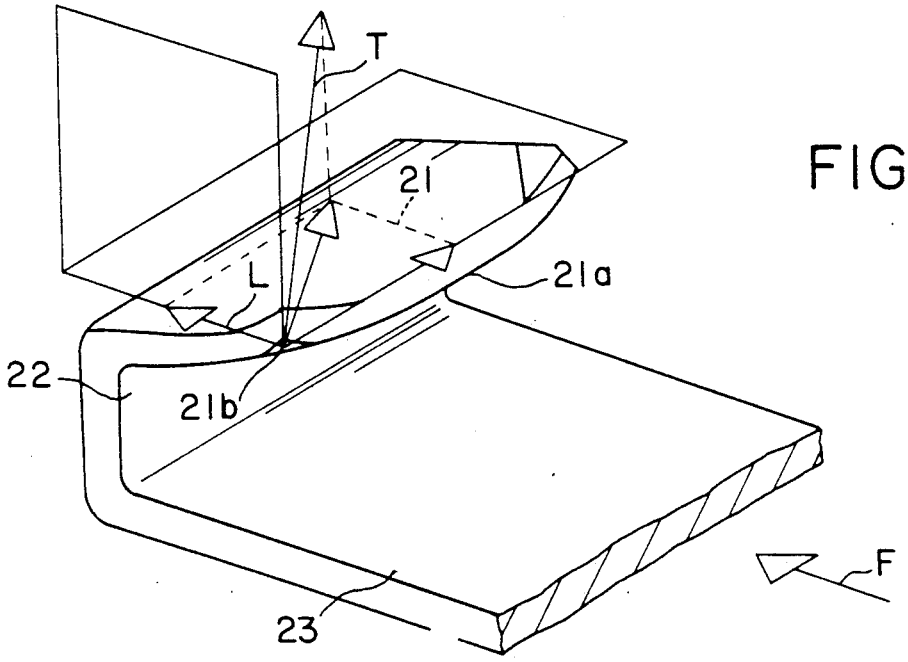
FIG. 3

MOUNTING DEVICE FOR CROSS-COUNTRY SKI BOOT

FIELD OF THE INVENTION

The present invention relates to a mounting device, called "hinge", for a cross-country ski boot having, at its front end, a transverse hinge pin which, while remaining free to rotate, is locked in position between a stationary jaw comprising a vertical abutment and a movable sliding jaw of the device, the movable jaw being biased longitudinally by elastic means, such as a spring, toward the stationary jaw in order to lock the pin of the boot in position.

SUMMARY OF THE INVENTION

An object of the present invention is an improved mounting device of this type, and in particular to provide the possibility of disengagement, i.e., of release, by means of displacement of the movable jaw when the latter undergoes excessive stress, and especially in the event of a hard fall, particularly when torsional motion is produced.

Another object of the invention consists in providing a stress-limiting system allowing disengagememt of the binding in the event of excessively violent stress, so as to avoid wrenching or damaging of the binding because the lightness requirements associated with equipment of this kind and in order to optimize a mounting device of this type with respect to its weight.

Finally, the present invention must also allow the hinge pin to be installed in the mounting device when snow "packing" is present in the movable jaw.

These objects are achieved in the mounting device according to the invention, which is of the above-mentioned type, by virtue of the fact that the movable jaw, when viewed in transverse section, is in substantially the shape of a hook designed to grip the pin of the boot at least longitudinally and vertically, and because this hook comprises a hortizontal arm having, in longitudinal section, a ramp-shaped profile which increases in size in the direction of the stationary jaw.

This ramp shape of the horizontal arm of the movable jaw makes it possible, when the pin of the boot rests for support on this wall, and particularly in the event of a fall, to obtain a horizontally-directed stress component which resists the stress exerted by elastic means biasing the movable jaw into the locked position.

In the event of a violent stress on the movable jaw, this horizontal component can be sufficient to completely oppose the elastic means and allow the movement of this movable jaw toward the release position.

This ramp shape of the horizontal arm of the hook also makes it possible to compensate for the snow "balls" which may form within the hook.

As another advantage, the horizontal branch of the hook has, on each of its transversely extending lateral ends, a ramp-shaped profile which increases in size as it extends from the interior to the exterior of the arm, thereby also allowing release of the mounting device in the event of stress exerted obliquely or, in particular, transversely.

BRIEF DESCRIPTION OF THE DRAWINGS

The device according to the invention will be better understood, and other features will emerge, from the following description provided with reference to the attached schematic drawings which illustrate, by way of non-limiting example, a preferred embodiment and in which:

FIG. 1 is schematic side view;

FIG. 2. is a view seen from the direction of arrow F in FIG. 3;

FIG. 3 is a perspective view of the movable jaw.

DESCRIPTION OF THE PREFERRED EMBODIMENTS

As shown in FIG. 1, the mounting device according to the invention is constituted basically by a stationary jaw 10, in the present embodiment comprising a vertical stop, and a movable jaw 20 which slides longitudinally and is biased by elastic means 30, such as a spring, toward the stationary jaw 10, in order to lock a hinge pin 1 of the boot into position between these two jaws.

A mounting device of this kind is termed "hinge type," since it causes the pin of the boot to lock in position while allowing it to rotate.

A device of this kind is also continuously biased into the locking position by the spring or the elastic means 30.

In the illustrated embodiment, the movable jaw 20 has, when viewed in transverse section, substantially the shape of a hook having a horizontal arm 21, a vertical wall 22, and a guide piece 23 extending, in the present instance, beneath the stationary jaw, but which can also extend in the opposite direction.

The embodiments of the stationary jaw 10 of the movable jaw 20 shown are, of course, in no sense limiting examples, and the stationary jaw 10 could also delimit a lower zone of support for the hinge pin 1 in place of the guide piece 23 of the movable jaw.

In this case, it is important for the stationary jaw 10 to have a support surface for the hinge pin 1, and for the movable jaw 20 to have one or several support surfaces designed to cooperate with the vertical wall 10 of the stationary jaw in order to grip the pin 1 longitudinally and vertically.

It will be understood that the longitudinal and transverse directions are referred to in relation to the ski to which the mounting device is to be attached.

As shown more particularly in FIG. 1, the horizontal arm 21 of the hook has a longitudinally ramp-shaped profile 21*a* which increases in the direction of the stationary jaw 10, this ramp 21*a* forming an angle $\alpha$ with the horizontal. Thus, when a vertical stress V is applied to the hinge pin, ramp 21*a* produces a horizontal component L extending longitudinally in a direction opposite to the stationary jaw 10. This stress L thus opposes the locking force generated by the elastic means 30.

It will be understood that force L will be greater or smaller depending on the angle of the ramp 21*a* selected, and that, for a large vertical force produce, for example in the event of a forward fall, the horizontal component L will be sufficient to allow the release of the mounting device, this mechanism thereby providing an important safety factor.

Angle $\alpha$ will be determined by those skilled in the art as a function of the desired disengagement values and of the type of user (and especially of the weight of the latter, depending on whether the user is a child or an adult).

In practice, this angle $\alpha$ will range between 5° and 15°.

It will also be understood that ramp 21*a* of horizontal arm 21 makes it possible to compensate for the possible presence of snow on the inside of movable jaw 20 and allows the hinge pin 1 to be inserted in the hook 20, even when a layer of snow covers portion 23 of the hook, because of the incline of the ramp.

In the example shown, the hinge pin 1 is pressed for support against the ramp 21*a*, and is therefore in normal position, held in the mounting device between arms 21 and 23 of the movable jaw 20 and the stationary jaw 10.

Play could also be provided between pin 1 and arm 21, so that the pin is held between arms 22 and 23 of the movable jaw 20 and the stationary jaw. Such play should, of course, be as slight as possible in order to avoid wobbling.

As shown in FIGS. 2 and 3, the horizontal arm of the hook also has a ramp-shaped profile on each of its lateral ends extending transversely, this shape increasing in size as it extends from the interior to the exterior of the arm. Each of the ramps 21*b* forms, then, an outwardly opening angle $\beta$ to the horizontal.

An arrangement of this kind makes it possible to take into account a stress T directed obliquely and therefore having components which fall simultaneously into a horizontal and a vertical plane (FIG. 3). In fact, in the event of a stress of this kind exerted by the hinge pin 1 at one of the ramps 21*b*, a horizontal component L directed longitudinally and in the direction opposite to that of the stationary jaw 10 is created.

As in the case of the stress L produced by the slope of ramp 21*a*, the stress L generated by the slope of each of the ramps 21*b* resists the locking force generated by the elastic means and can allow disengagement of the hinge pin from the mounting device for a given intensity of oblique stress T.

The provision of such ramps 21*b* therefore constitutes an additional safety factor in the event, for example, of a fall involving a twisting movement of the leg. As previously specified, angle $\beta$ will be determined as a function of the desired disengagement values and of the user, and will, in practice, range from 5° to 20°.

It will be noted that the estimate of the disengagement values determined for the mounting device allows the calculation of the various device components for a given stress, and therefore makes it possible to optimize the calculation of these components as regards weight, a particularly important factor given the constraints imposed by the lightness required for cross-country skiing.

The present invention is not limited to the embodiment of the lever described nor to the automatic mounting device as shown in the drawings.

What is claimed is:

1. Mounting device for a cross-country ski boot having a front end comprising a freely rotatable transverse hinge pin (1) which is locked in position between a stationary jaw (10) attached to a ski and a sliding movable jaw (20) biased longitudinally by elastic means toward said stationary jaw, said movable jaw (21) having, in transverse section, substantially the shape of a hook adapted to grip said hinge pin at least longitudinally and vertically, and said hook comprising a horizontal arm (21) having, in transverse section, a ramp-shaped profile (21*a*) which ascends in the direction of said stationary jaw (10).

2. Mounting device according to claim 1, said ramp-shaped profile (21*a*) has a ramp angle in a range of 5° to 15°.

3. Mounting device for a cross-country ski boot having, at a front end of said boot, a freely rotatable transverse hinge pin (1) which is locked in position between a stationary jaw (10) attached to a ski and a sliding movable jaw (20) biased longitudinally by elastic means toward said stationary jaw, said movable jaw (21) having, in transverse section, substantially the shape of a hook adapted to grip said hinge pin at least longitudinally and vertically, said hook comprising a horizontal arm (21) having, on each of transversely extending lateral ends of said horizontal arm, a ramp-shaped profile (21*b*) ascending from an interior to an exterior of said horizontal arm (21).

4. Cross-country mounting device according to claim 3, wherein said ramp-shaped profile (21*b*) has a ramp angle ($\beta$) in the range of 5° to 20°.

* * * * *